US010337264B2

(12) United States Patent
Rothe et al.

(10) Patent No.: US 10,337,264 B2
(45) Date of Patent: Jul. 2, 2019

(54) MOVABLE TONG ASSEMBLY

(71) Applicant: Weatherford Technology Holdings, LLC, Houston, TX (US)

(72) Inventors: Jan Rothe, Hannover (DE); Georg Zimbelmann, Lehrte (DE); Bjoern Thiemann, Burgwedel (DE); Martin Liess, Seelze (DE)

( * ) Notice: Subject to any disclaimer, the term of this patent is extended or adjusted under 35 U.S.C. 154(b) by 136 days.

(21) Appl. No.: 15/357,823

(22) Filed: Nov. 21, 2016

(65) Prior Publication Data

US 2018/0142524 A1 May 24, 2018

(51) Int. Cl.
*E21B 19/16* (2006.01)

(52) U.S. Cl.
CPC ..... *E21B 19/161* (2013.01); *E21B 19/165* (2013.01)

(58) Field of Classification Search
CPC ..... E21B 19/161; E21B 19/16; E21B 19/168; E21B 19/00
See application file for complete search history.

(56) References Cited

U.S. PATENT DOCUMENTS 3,760,658 A * 9/1973 Guier ..... E21B 19/16 81/57.34
4,348,920 A 9/1982 Boyadjieff
4,585,079 A 4/1986 Lemaire et al.
4,592,125 A 6/1986 Skene
4,619,159 A 10/1986 Kurek
5,060,542 A * 10/1991 Hauk ..... E21B 19/163 81/57.16
5,259,275 A 11/1993 Schulze-Beckinghausen
5,386,746 A 2/1995 Hauk
5,390,568 A * 2/1995 Pietras ..... E21B 19/16 81/57.16
5,758,553 A 6/1998 Perry
5,868,045 A 2/1999 Hauk
6,142,041 A 11/2000 Buck
6,263,763 B1 7/2001 Feigel et al.
6,360,633 B2 3/2002 Pietas
6,488,094 B1 12/2002 McDowell
6,776,070 B1 8/2004 Mason et al.
7,188,547 B1 * 3/2007 West ..... E21B 19/161 81/57.16
7,188,548 B2 3/2007 Liess
2002/0035897 A1 3/2002 Buytaert et al.
2002/0104408 A1 8/2002 Hawkins, III
2002/0157823 A1 10/2002 Pietras et al.
2004/0216890 A1 11/2004 Hemphill et al.
2005/0056122 A1 * 3/2005 Belik ..... E21B 19/161 81/57.16

(Continued)

OTHER PUBLICATIONS

PCT International Search Report and Written Opinion dated Jan. 31, 2018, for International Application No. PCT/US2017/058181.

*Primary Examiner* — James G Sayre
(74) *Attorney, Agent, or Firm* — Patterson + Sheridan, LLP

(57) ABSTRACT

A tong assembly includes a power tong, a backup tong, and a carriage assembly operatively connecting the power tong and the backup tong. The carriage assembly includes a movable trolley assembly. The movable trolley assembly is axially located between the power tong and the backup tong. The movable trolley assembly is supported by the power tong. The movable trolley assembly is configured to axially move the power tong and backup tong relative to each other.

22 Claims, 16 Drawing Sheets

(56) References Cited

U.S. PATENT DOCUMENTS

| | | | | |
|---|---|---|---|---|
| 2009/0235786 | A1* | 9/2009 | Stensland | E21B 19/165 81/57.34 |
| 2012/0111155 | A1* | 5/2012 | Holen | E21B 19/163 81/57.35 |
| 2016/0123094 | A1* | 5/2016 | Amezaga | E21B 19/165 166/380 |
| 2018/0016854 | A1* | 1/2018 | Rogers | G01V 3/28 |

* cited by examiner

MOVABLE TONG ASSEMBLY

BACKGROUND OF THE DISCLOSURE

Field of the Disclosure

Embodiments of the present disclosure generally relate to an apparatus for making up and breaking out tubular connections. More particularly, embodiments of the present disclosure relate to a tong assembly for use in making up and breaking out tubular connections within a tubular string of an oil or gas well.

Description of the Related Art

Construction of oil or gas wells usually requires making long tubular strings that make up casing, risers, drill pipe, or other tubing. Due to the length of these strings, sections or joints of tubulars are progressively added to or removed from the tubular strings as they are lowered or raised from a drilling platform. A tong assembly including a power tong and a backup tong is commonly used to make up or break out joints in the tubular strings.

The power tong and the backup tong are typically vertically spaced from each other by a fixed distance. In some situations, however, it is desirable to be able to adjust the vertical spacing between the power tong and the backup tong. Therefore, there is a need for a movable tong assembly in which the vertical spacing between the power tong and the backup tong is adjustable.

SUMMARY OF THE DISCLOSURE

An embodiment of the present disclosure includes a tong assembly having a power tong; a backup tong; and a carriage assembly operatively connecting the power tong and the backup tong, the carriage assembly including a movable trolley assembly, the movable trolley assembly axially located between the power tong and the backup tong, wherein the movable trolley assembly is supported by the power tong, the movable trolley assembly being configured to axially move the power tong and backup tong relative to each other.

Another embodiment of the present disclosure includes a tong assembly having a power tong; a backup tong; a support structure configured to support the power tong above a ground surface; and a carriage assembly operatively connecting the power tong and the backup tong, the carriage assembly configured to axially adjust a vertical distance between the power tong and the backup tong, the carriage assembly being distinct and separate from the support structure.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 1 illustrates a perspective view of the movable tong assembly in the first configuration. FIG. 2 illustrates a side view of the movable tong assembly in the first configuration. FIG. 3 illustrates a front view of the movable tong assembly in the first configuration.

FIG. 4 illustrates a perspective view of the movable tong assembly in the second configuration. FIG. 5 illustrates a side view of the movable tong assembly in the second configuration. FIG. 6 illustrates a front view of the movable tong assembly in the second configuration.

FIG. 7 illustrates a perspective view of the carriage assembly. FIG. 8 illustrates a front view of the carriage assembly FIG. 9 illustrates a side view of the support structure supporting the movable tong assembly in the first configuration. FIG. 10 illustrates a side view of the support structure supporting the movable tong assembly in the second configuration.

DETAILED DESCRIPTION

The present disclosure generally relates to a tong assembly for making up and breaking out a tubular connection between two tubulars in a tubular string. The tubular strings may be made of tubulars that form risers, casings, drill pipes, or other tubulars in oil and gas wells. An embodiment of the present disclosure relates to a tong assembly including a power tong, a backup tong, and a carriage assembly operatively connecting the power tong and the backup tong. The carriage assembly is configured to axially move the power tong and the backup tong relative to each other.

Figure 9:
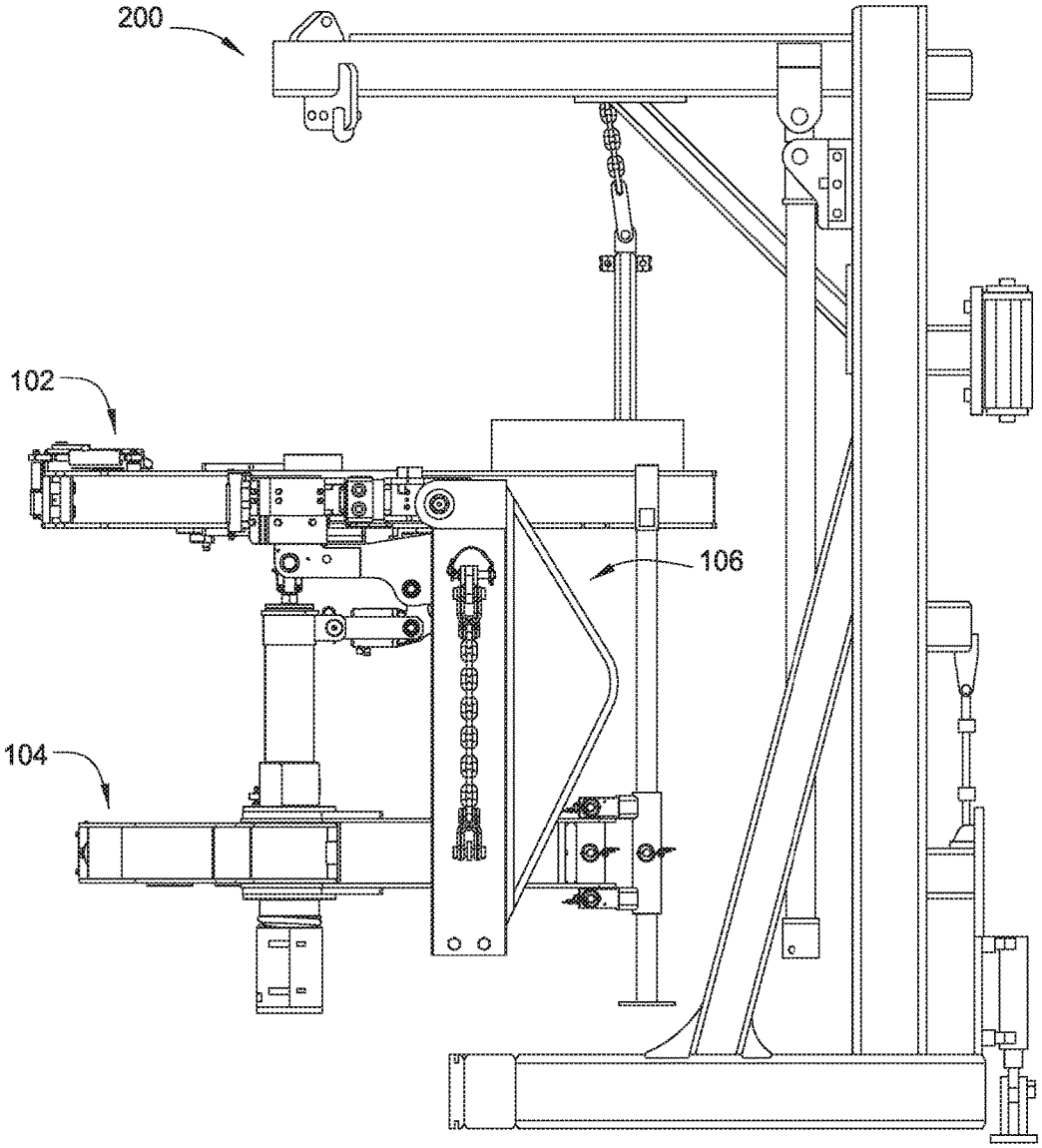
FIGS. 9-10 illustrate an embodiment of a support structure connected to the movable tong assembly shown in FIGS. 1-6.
Figure 10:
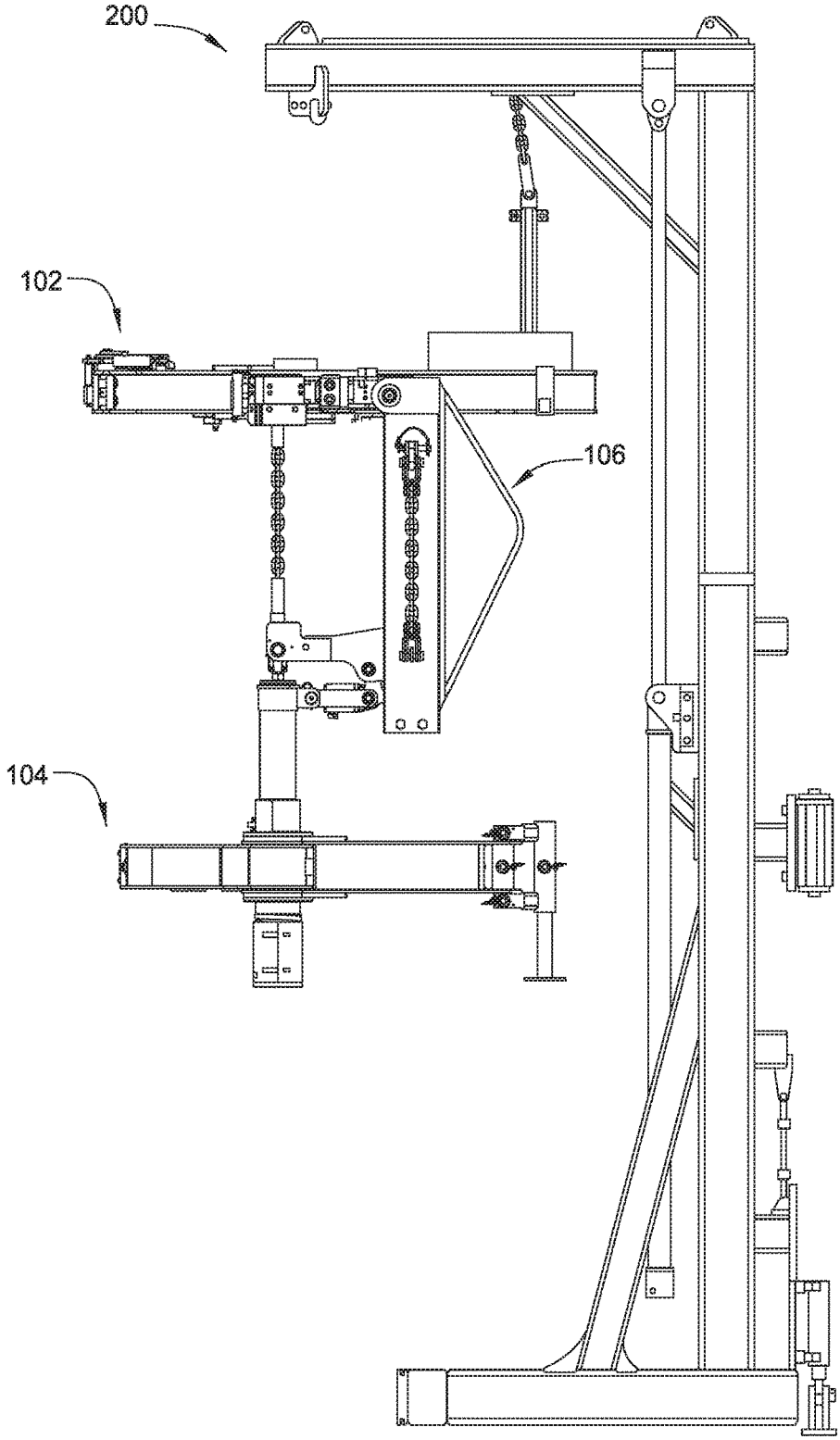

FIGS. 1-6 illustrate a tong assembly 100 according to one embodiment of the present disclosure. The tong assembly 100 includes a power tong 102 and a backup tong 104. The power tong 102 and the backup tong 104 may be operatively connected by a carriage assembly 106. As shown in FIGS. 9-10, a support structure may be connected to the power tong 102 and/or the backup tong 104 in a manner to support a weight of the power tong 102, the backup tong 104, and the carriage assembly 106. The carriage assembly 106 may be distinct and separate from the support structure such that the carriage assembly 106 may be implemented with an existing support structure without having to make substantial modifications to the support structure. As shown in FIGS. 9-10, in one embodiment, the support structure is a hydraulic lift stand 200 connected to the power tong 102, with the carriage assembly 106 being supported by the power tong 102 and the backup tong 104 being supported by the carriage assembly 106. In this manner, although the hydraulic lift stand 200 is connected only to the power tong 102, the stand ultimately supports the weight of the power tong, the backup tong 104, and the carriage assembly 106. A person of ordinary skill in the art will understand that hydraulic lift stand 200 shown in FIGS. 9-10 could be altered, for example, such that the stand is also connected to the backup tong 104. Additionally, a person of ordinary skill in the art will understand that support structure could be a handling tool rather than a stand.

The power tong 102 may include a frame 108 with a central opening 110 for receiving a tubular. The frame 108 may include two or more sections movable relative to each other to open and close the central opening 110. In one embodiment, the frame 108 may include two front sections 108*a*, 108*b* and one back section 108*c*. Each of the front sections 108*a*, 108*b* are connected to the back section 108*c* in a manner such that the front sections are pivotable relative to the back section.

The power tong 102 may further include a rotor 112 disposed in the frame 108. The rotor 112 may be a segmented rotor. The rotor 112 may be coupled to a motor assembly 114. Jaws 116 may be attached to an inner diameter of the rotor 112. The jaws 116 may rotate with the rotor 112 to rotate a tubular about a longitudinal axis 101 during make up and break out of a tubular connection. The jaws 116 may move radially relative to the frame 108 to secure and release a tubular or to accommodate tubulars of various diameters. In one embodiment, the jaws 116 may be driven using a hydraulic circuit.

The backup tong 104 may include a frame 118 with a central opening 120 for receiving a tubular. The backup tong 104 may be disposed underneath the power tong 102 in a manner such that the longitudinal axis 101 extends through central opening 110 of the power tong 102 and through central opening 120 of the backup tong. The frame 118 may include two or more sections movable relative to each other to open and close the central opening 120. In one embodiment, the frame 118 may include two front sections 118*a*, 118*b* and one back section 118*c*. Each of the front sections 118*a*, 118*b* are connected to the back section 118*c* in a manner such that the front sections are pivotable relative to the back section. The backup tong 104 may further include jaws 122 attached to the frame 118 to secure and release a tubular or to accommodate tubulars of various diameters. In one embodiment, the jaws 122 may be driven using a hydraulic circuit.

The backup tong 104 may further include support legs 124. The frame 118 may be movably coupled to the support legs 124. Lower ends 125 of the support legs 124 are configured to stand on a platform or other stationary surfaces. The support legs 124 are configured to support the frame 118 of the backup tong 104 and prevent the backup tong from rotating during operation of the tong assembly 100. In one embodiment, the frame 118 has through openings for receiving support legs 124 therein. In one embodiment, sleeves 128 may provide a place for connection to support legs 124. In one embodiment, the frame 118 may be coupled to two support legs that are symmetrically positioned about the longitudinal axis 101. In one embodiment, the two support legs 124 and the longitudinal axis 101 may be within the same plane. Each support leg 124 may include a spring member 126 disposed at lower ends 125. The weight and vertical load of the backup tong 104 may rest on the spring members 126. The spring members 126 allow the backup tong 104 to be movable along the support legs 124 thus providing structural flexibility for the tong assembly 100.

The power tong 102 and the backup tong 104 may be operatively connected by the carriage assembly 106. The carriage assembly 106 may be adapted to adjust between a first configuration illustrated in FIGS. 1-3 and a second configuration illustrated in FIGS. 4-6. In the first configuration, the power tong 102 is spaced from the backup tong 104 by a first vertical distance. In the second configuration, the power tong 102 is spaced from the backup tong 104 by a second vertical distance that is greater than the first vertical distance. Although the figures of the disclosure show only two configurations for the carriage assembly 106, it is to be understood that the carriage assembly could be configured to be adjustable for additional configurations that either increase or decrease a vertical distance between power tong 102 and backup tong 104. The carriage assembly 106 may connect the power tong 102 and the backup tong 104 in a manner such that the backup tong 104 remains substantially vertically aligned with the power tong 102 as the carriage assembly 106 adjusts from the first configuration to the second configuration.

Figure 7:
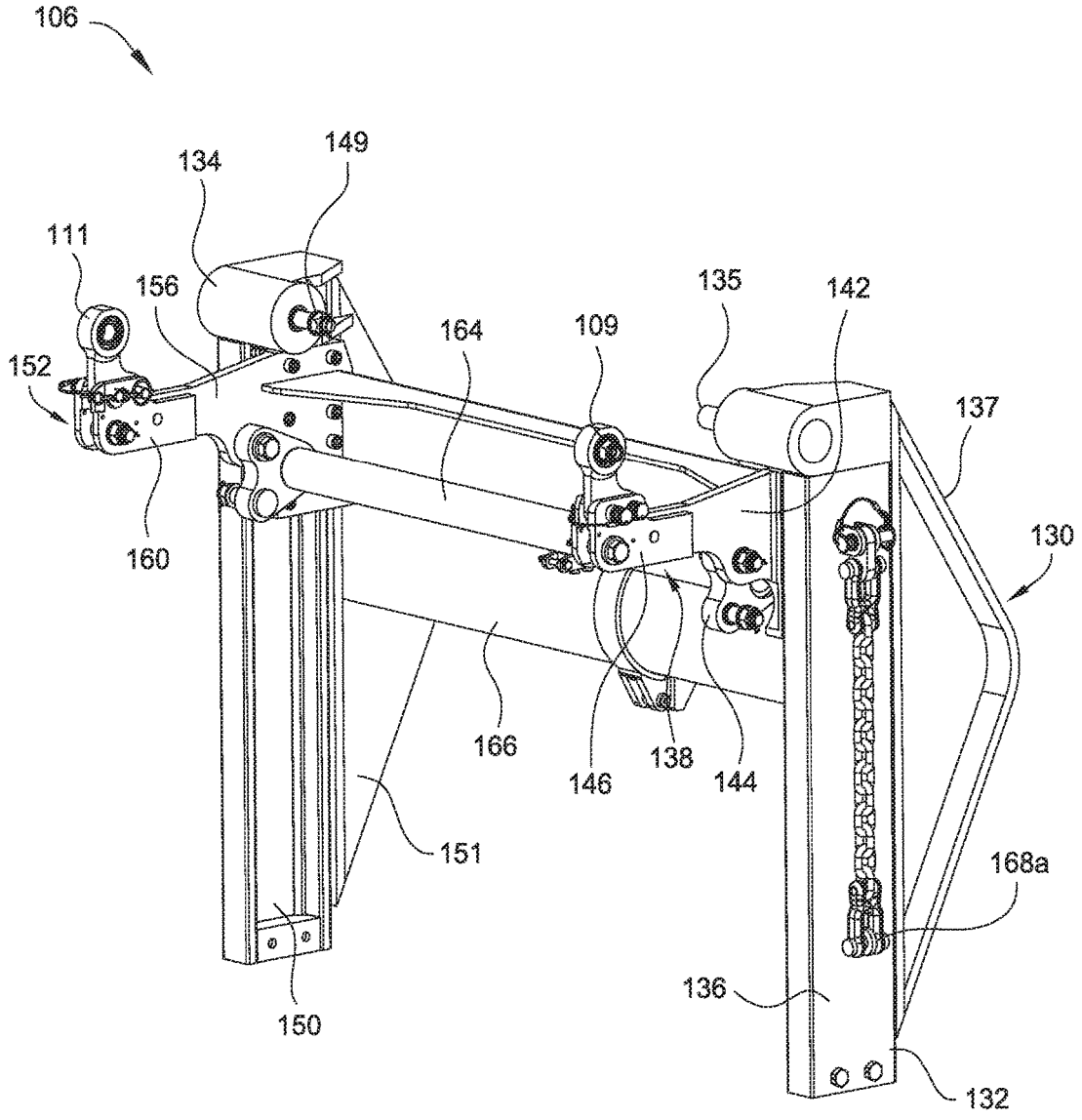
FIGS. 7-8 illustrate an embodiment of a carriage assembly of the movable tong assembly shown in FIGS. 1-6.
Figure 8:
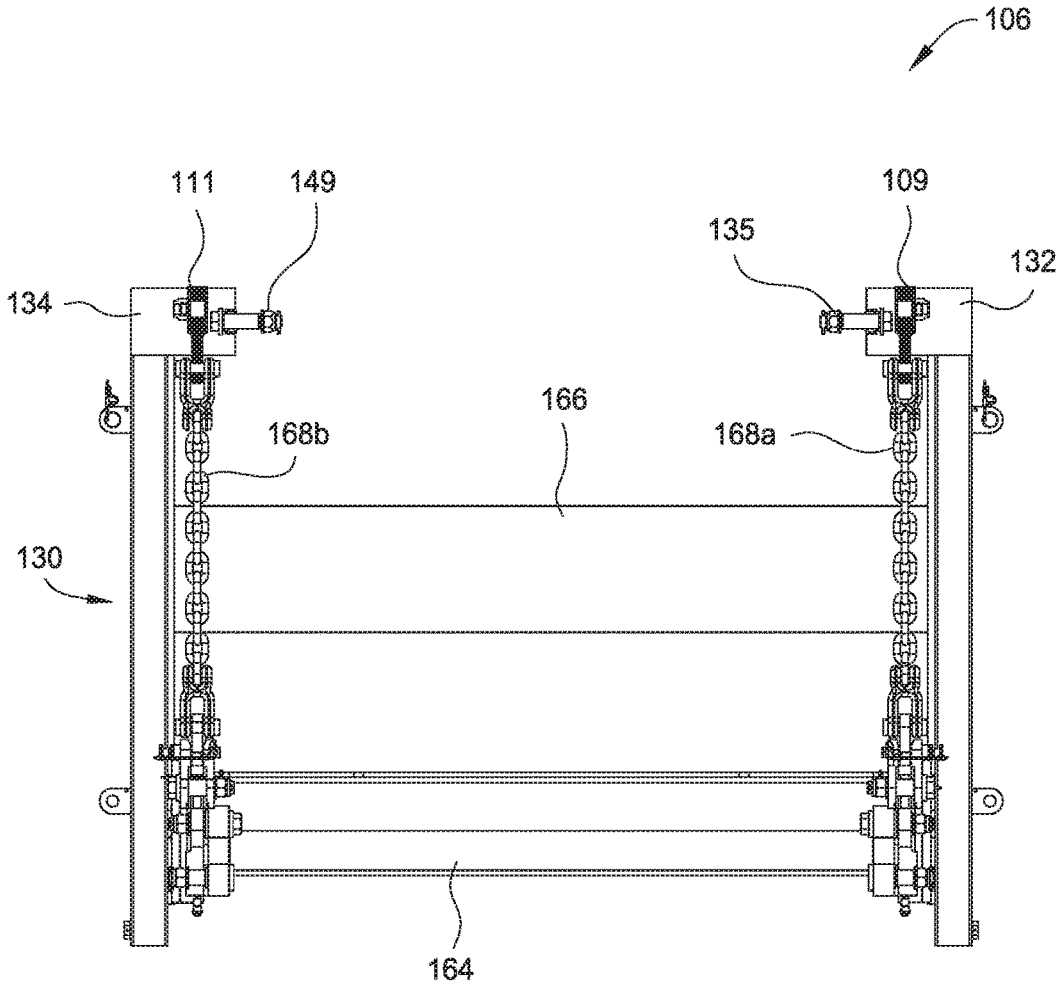

As best seen in FIGS. 7-8, the carriage assembly 106 may include a movable trolley assembly 138 and a bracket assembly 130. The movable trolley assembly 138 may include a pair of trolley wheels (not shown), a first trolley bracket 142, a second trolley bracket 156, a first bell crank 144, a second bell crank 146, a third bell crank 158, a fourth bell crank 160, a link 148, and a link 162. The link 148 and link 162 can be seen in FIG. 4. Bell crank 146 may be rigidly connected to trolley bracket 142 by a weld joint, and bell crank 144 may be pivotally connected to trolley bracket 142. Bell crank 160 may be rigidly connected to trolley bracket 156 by a weld joint, and bell crank 158 may be pivotally connected to trolley bracket 152.

The bracket assembly 130 of the carriage assembly 106 may include a first bracket 132 and a second bracket 134. The first bracket 132 may include an attachment protrusion 135, a channel 136, and a gusset 137. The second bracket 134 may include an attachment protrusion 149, a channel 150, and a gusset 151.

The movable trolley assembly 138 and the bracket assembly 130 may be assembled such that one of the trolley wheels and trolley bracket 142 collectively sandwich a portion of the channel 136, and the other trolley wheel and trolley bracket 156 collectively sandwich a portion of the channel 150, with the trolley wheels located within grooves of channel 136 and channel 150. In this manner, movable trolley assembly 138 may be movable relative to channel 136 and channel 150 by the pair of trolley wheels moving upwardly and downwardly within the grooves of the channels. As such, the movable trolley assembly 138 is slidably connected to channel 136 and channel 150.

Figure 4:
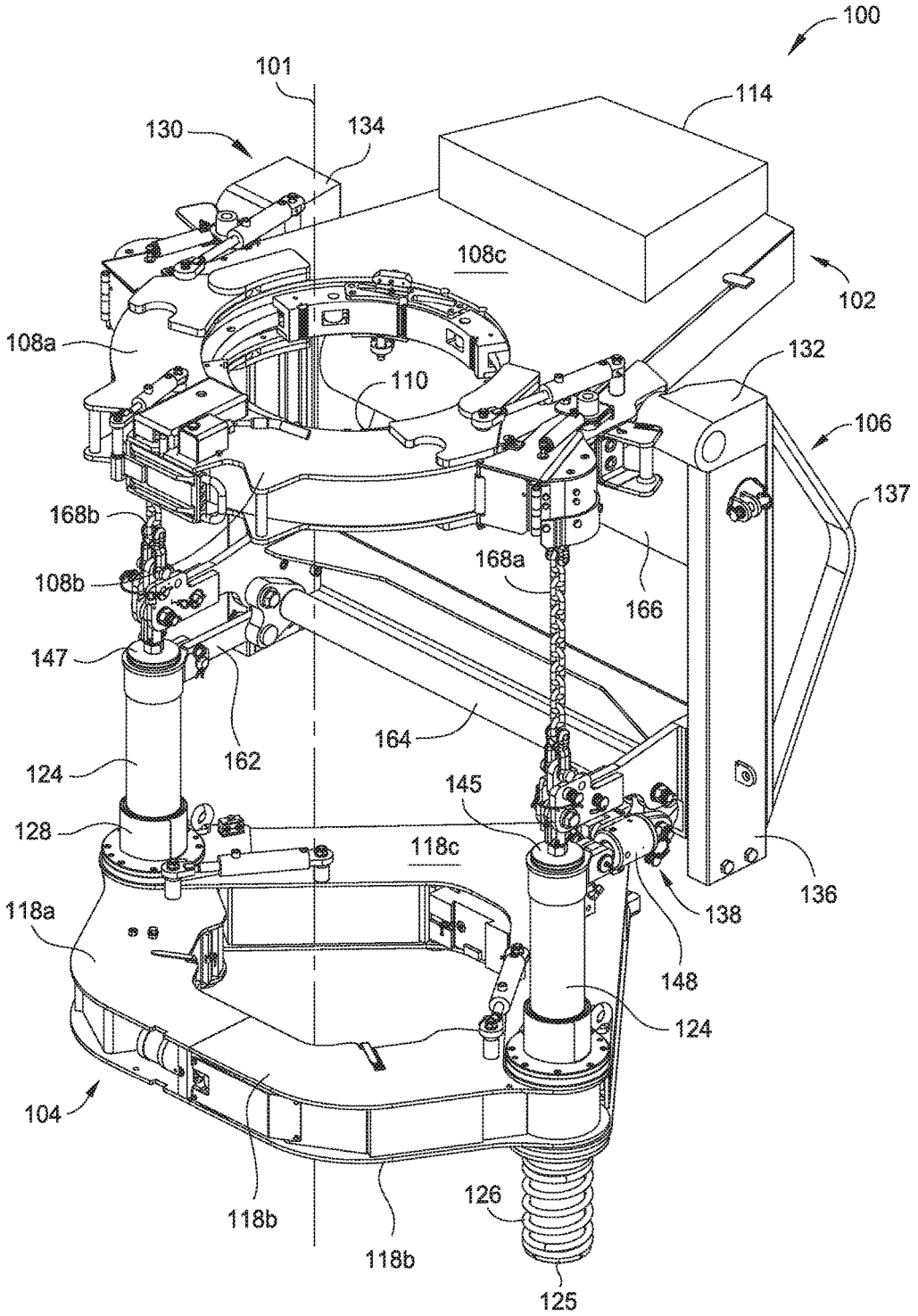
FIGS. 4-6 illustrate the movable tong assembly of FIGS. 1-3 in a second configuration.
Figure 5:
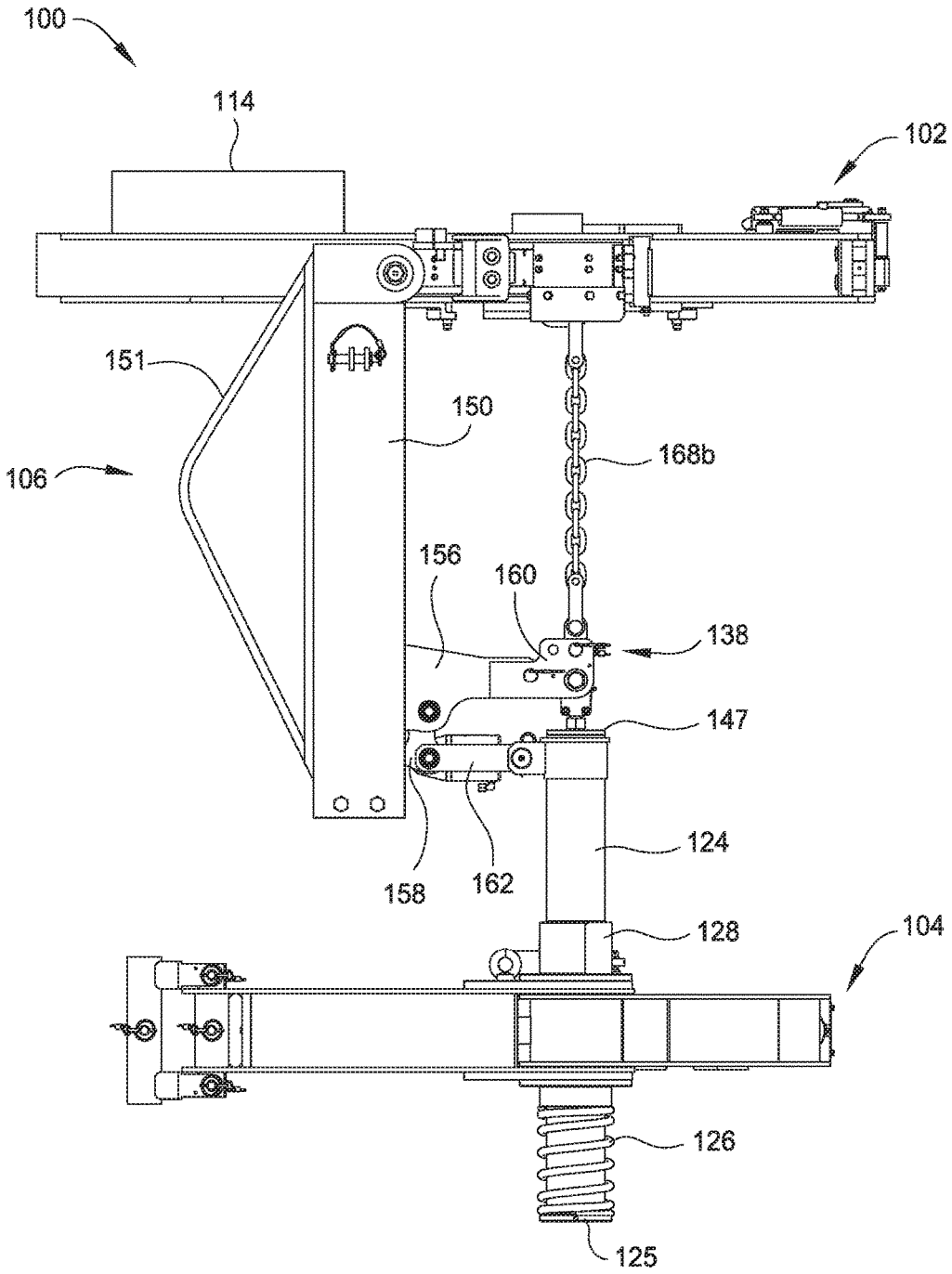
Figure 6:
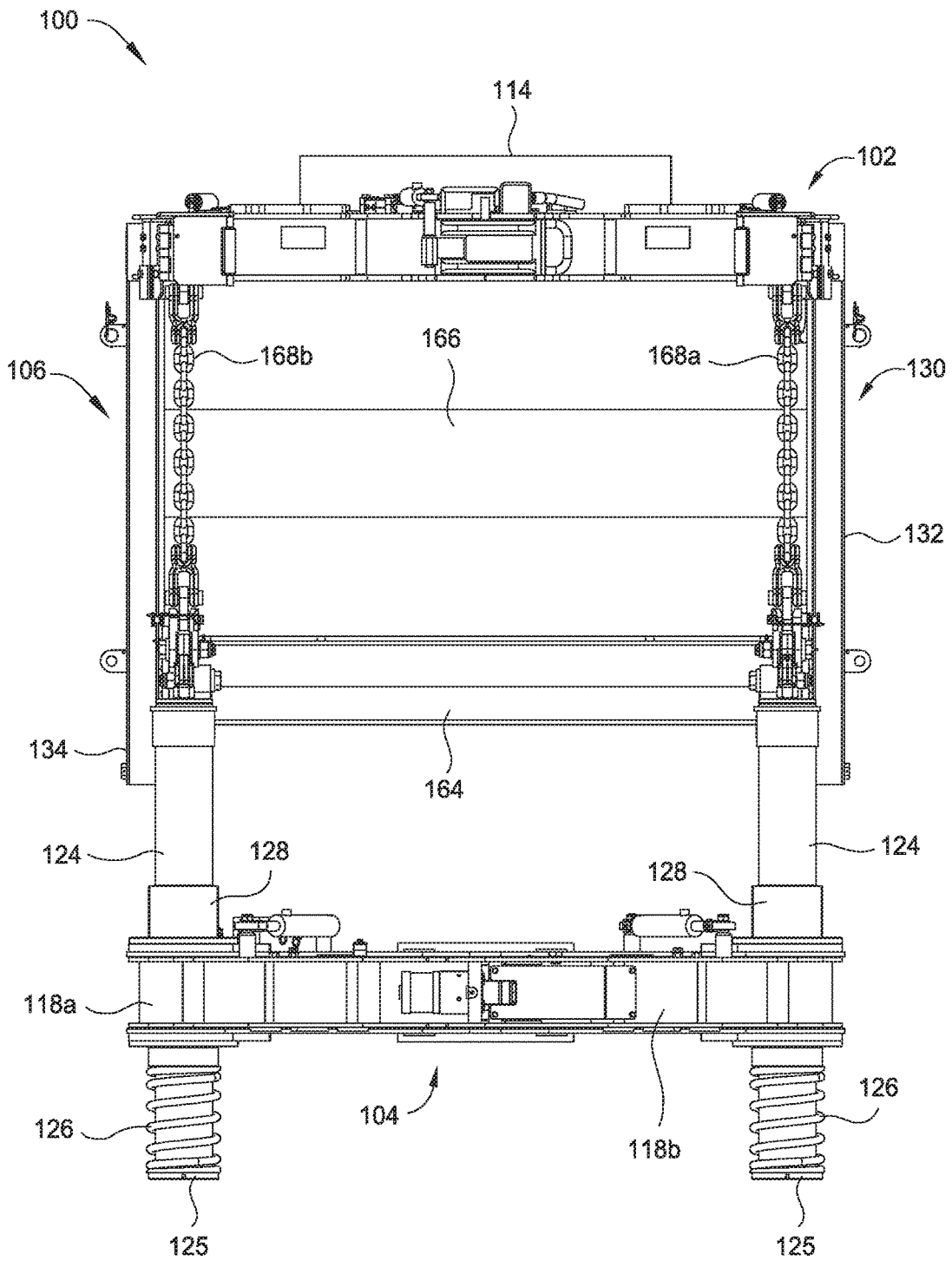

As best seen in FIG. 4, link 148 may be a torque measuring cell and link 162 may be a DMS electrical loadcell. In this manner, torque can be measured by these links. A person of ordinary skill in the art, however, will understand that 148 could be swapped with link 162. Moreover, a person of ordinary skill in the art will understand that link 148 and link 162 could both be plain links, electric loadcells, hydraulic loadcells, or any combination thereof.

Figure 1:
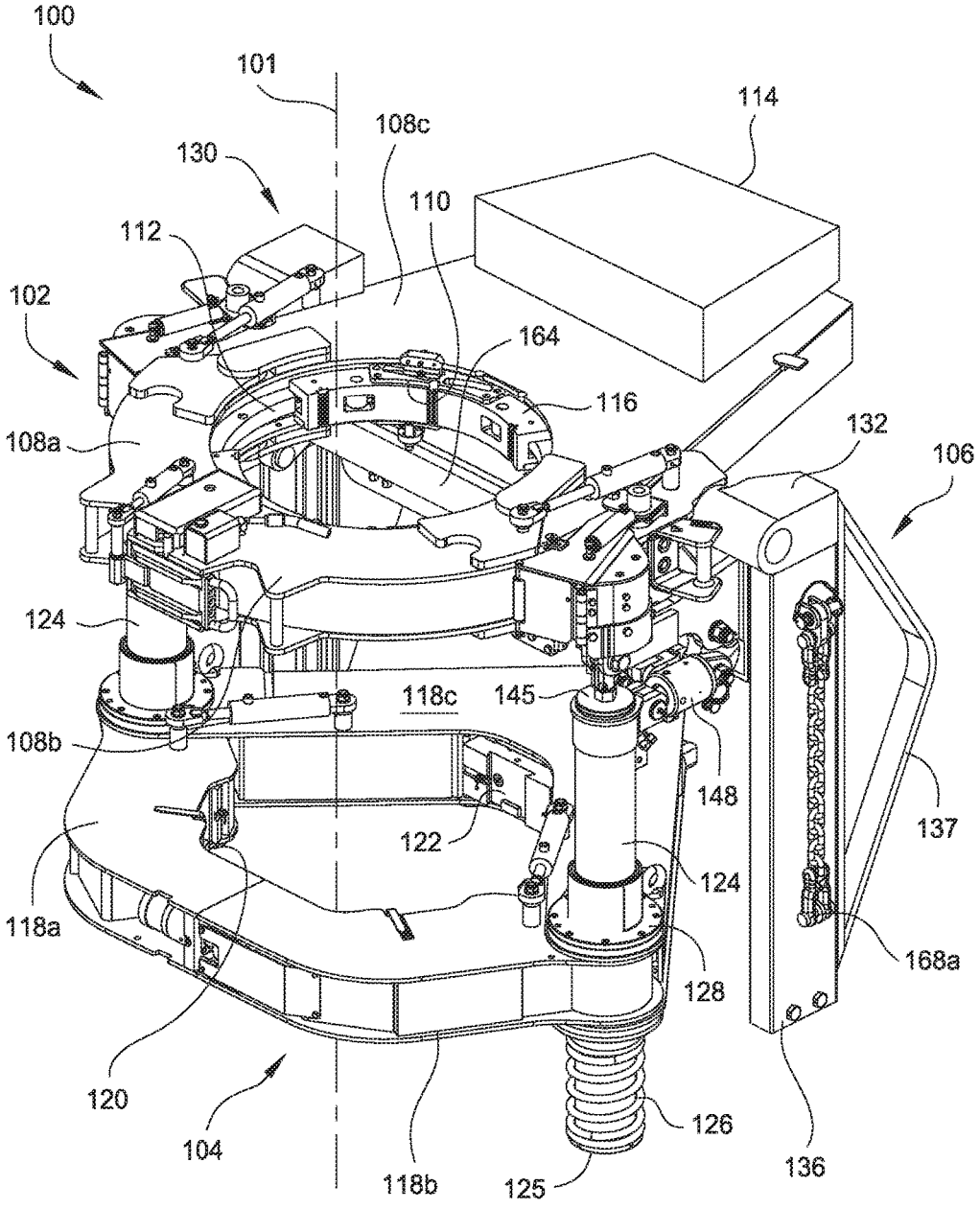
FIGS. 1-3 illustrate an embodiment of a movable tong assembly in a first configuration.
Figure 2:
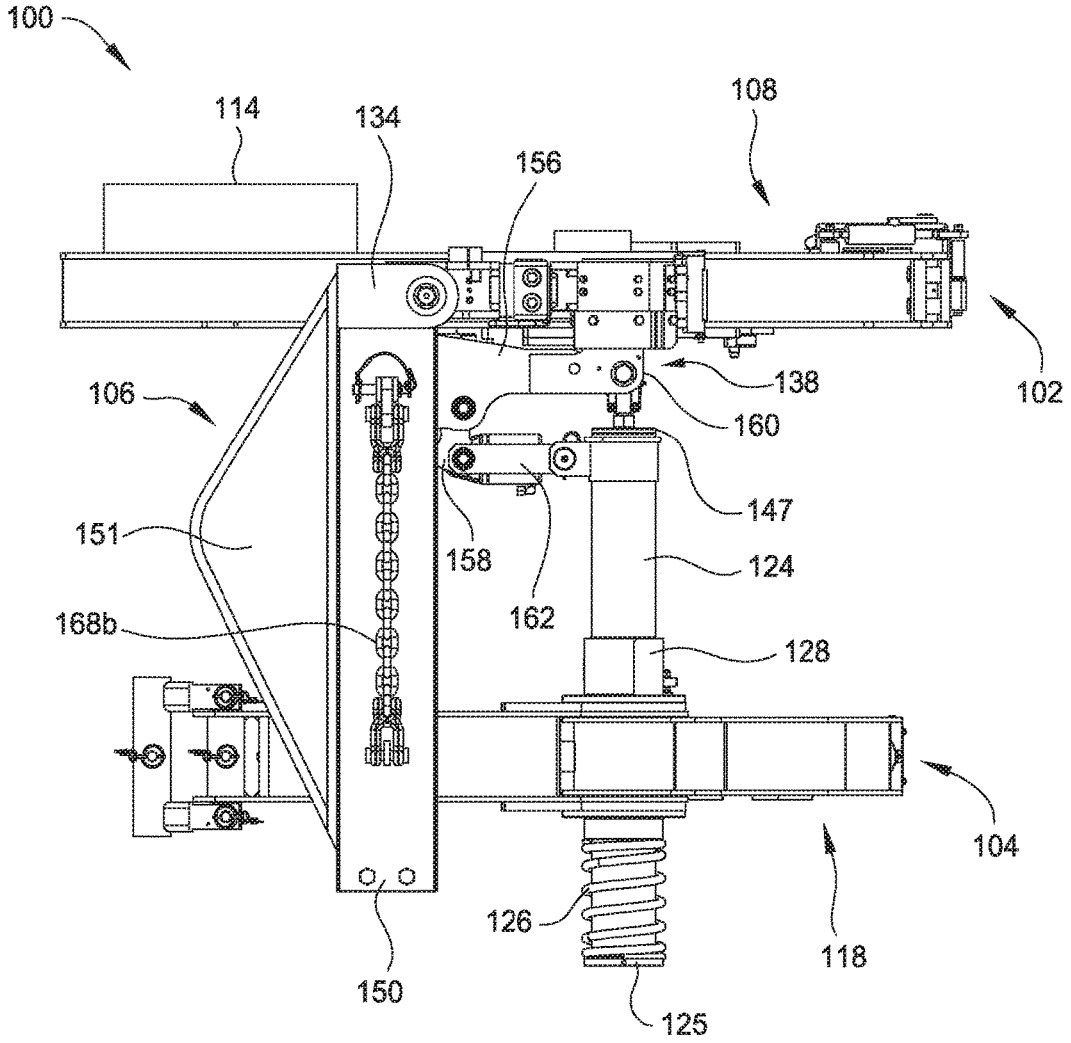
Figure 3:
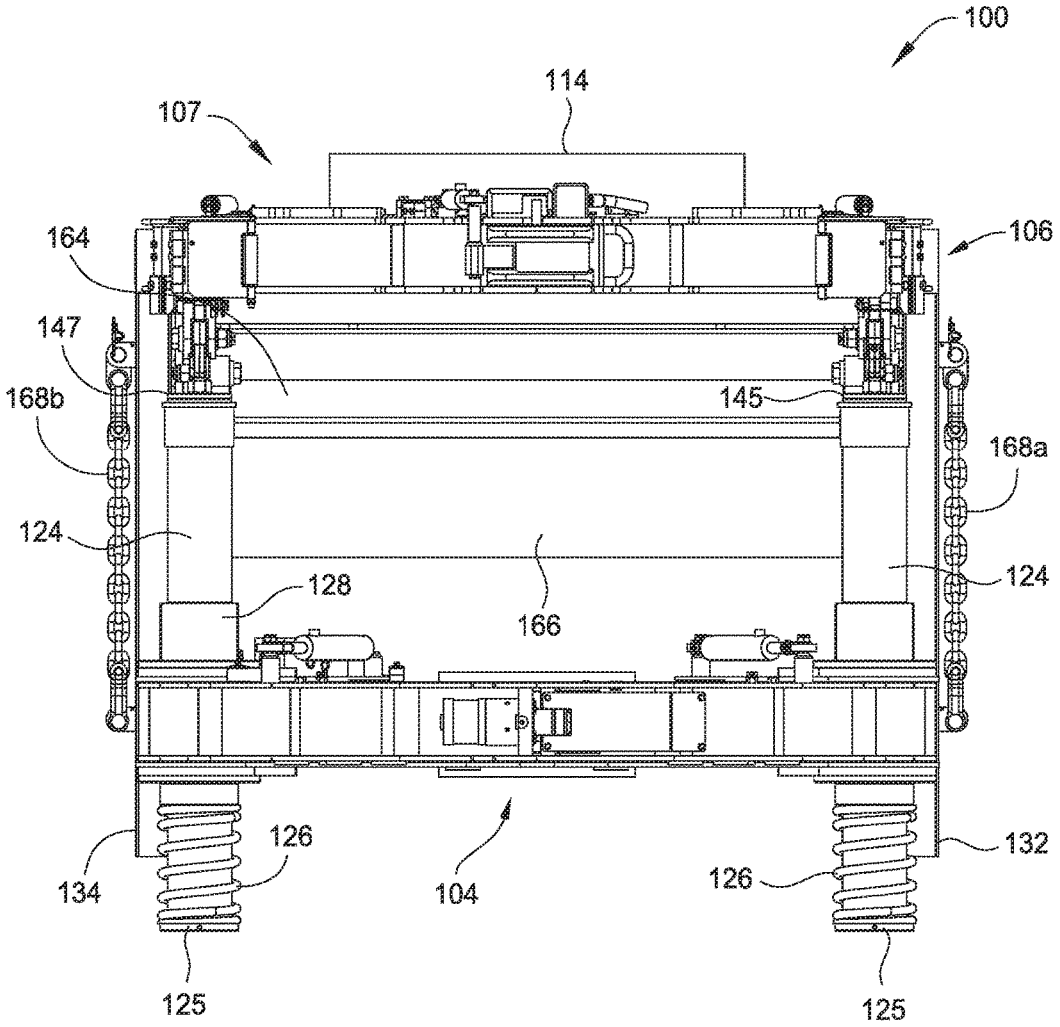

The carriage assembly 106 may further include a first horizontal torque bar 164 and a second horizontal torque bar 166, with the first horizontal torque bar being spaced from the second horizontal torque bar. As best seen in FIGS. 7 and 8, the first and second horizontal torque bars 164, 166 may be substantially horizontal. In one embodiment, the first horizontal torque bar 164 connects bell crank 144 to bell crank 158, and the second horizontal torque bar 166 connects gusset 137 of the first bracket 132 to gusset 151 of the second bracket 134. As illustrated in FIGS. 1-3, when the carriage assembly 106 is in the first configuration, the first torque bar 164 may be located vertically above the second torque bar 166. As illustrated in FIGS. 3-6, when the carriage assembly 106 is in the second configuration, the second torque bar 166 may be located vertically above the first horizontal torque bar 164. It is to be understood, however, that in some embodiments, the vertical arrangement of the first and second horizontal torque bars 164, 166 could be adjusted. In one embodiment, the second horizontal torque bar 166 may be of a larger size than the first horizontal torque bar 164, as torque counteracted by the second horizontal torque bar 166 when the carriage assembly 106 is in the second configuration may be greater than torque counteracted by the first horizontal torque bar 164 when the carriage assembly 106 is in the first configuration. It is to be understood, however, that the size of the first and second horizontal torque bars 164, 166 could be adjusted without deviating from the scope of the present disclosure. For example, the second horizontal torque bar 166 could be made of a different material than the first horizontal torque bar 164 such that the first and second horizontal torque bars may be the same size yet still enable the second horizontal torque bar to counteract a larger torque than the first horizontal torque bar. Alternatively, the bracket assembly 130 may include only a single torque bar that is capable of either being manually or automatically adjusted from one location of the bracket assembly to another location of the bracket assembly depending upon the configuration of the carriage assembly 106. In such a situation, the single torque bar will be of a size sufficient to counteract the torque associated with operation of the tong assembly 100 regardless of whether the carriage assembly 106 is in the first configuration, the second configuration, or any other additional configuration not shown in the present disclosure.

The carriage assembly 106 may further include a suspension cable 168*a*, 168*b*. In one embodiment, the carriage assembly 106 may include two suspension cables 168*a*, 168*b*. When the carriage assembly 106 is in the first configuration, suspension cable 168*a* may be stored on an outside surface of the first bracket 132 and suspension cable 168*b* may be stored on an outside surface of the second bracket 134. It is to be understood that suspension cables 168*a*, 168*b* may be stored at a different location on the first and second brackets when they are not in use. Alternatively, suspension cables 168*a*, 168*b* may be stored at a location separate from the first and second brackets when they are not in use. When in use, suspension cables 168*a*, 168*b* may connect the power tong 102 to the movable trolley assembly 138.

As best seen in FIGS. 1 and 4, the carriage assembly 106 operatively connects the power tong 102 and the backup tong 104 during operation of the tong assembly 100. Regardless of the configuration of the carriage assembly 106, the bracket assembly 130 may attach to the power tong 102 via attachment protrusion 135 of the first bracket 132 and attachment protrusion 149 of the second bracket 134. In this manner, each of the first and second brackets 132, 134 may have a connecting end and a free end, with the connecting ends being pivotally connected to the power tong 102 via the attachment protrusions and the free ends being spaced below the power tong.

Additionally, regardless of the configuration of the carriage assembly 106, the movable trolley assembly 138 may attach to support legs 124 of the backup tong 104 via link 148 and link 162. link 148 may be attached to bell crank 144 and link 162 may be attached to bell crank 158.

When the carriage assembly 106 is in the first configuration shown in FIGS. 1-3, movable trolley assembly 138 may be connected to the power tong 102 by adaptors 109, 111. More specifically, adaptor 109 may connect one side of frame 108 of the power tong 102 to bell crank 146 and adaptor 111 may connect another side of frame 108 to bell crank 160. Adaptors 109, 111 are best seen in FIGS. 7-8. In this manner, the power tong 102 supports the movable trolley assembly 138 in the first configuration. In one embodiment, bell cranks 146, 160 are coupled to the power tong 102 via adaptors 109, 111 such that bell cranks 146, 160 are symmetrically positioned about the longitudinal axis 101. Bell crank 146 may further be connected to a platform 145 that freely rests upon a first support leg 124*a* of the backup tong 104, and bell crank 160 may further be connected to a platform 147 that freely rests upon a second support leg 124*b* of the backup tong 104. Platforms 145, 147 are not rigidly connected to the first and second support legs 124*a*, 124*b* so that the backup tong 104 may move relative to the bell cranks 146, 160. This helps alleviate torsion and force being transmitted between the power tong 102 and the backup tong 104 via adaptors 109, 111 and bell cranks 146, 160 during operation of the tong assembly 100.

When the carriage assembly 106 is in the first configuration, the pair of trolley wheels of the movable trolley assembly 138 may be located at approximately the top of channels 136, 150. To adjust the carriage assembly 106 to the second configuration shown in FIGS. 4-6, adaptors 109, 111 may be disconnected from bell cranks 146, 160. The pair of trolley wheels may be moved slightly downward within their respective grooves of channels 136, 150 to lower movable trolley assembly 138 relative to the channels. Each of the suspension cables 168*a*, 168*b* may be manually removed from the outside surfaces of the first and second brackets 132, 134. One end of the first suspension cable 168*a* may be manually attached to adaptor 109 (which remains connected to the power tong 102) and the other end of the cable may be manually attached to bell crank 146. One end of the second suspension cable 168*b* may be manually attached to adaptor 111 (which remains connected to the power tong 102) and the other end of the second suspension cable may be manually attached to bell crank 160. In this manner, suspension cables 168*a*, 168*b* may connect bell cranks 146, 160 of the movable trolley assembly 138 to power tong 102 when the carriage assembly 106 is in the second configuration such that the power tong 102 supports the movable trolley assembly 138. After suspension cables 168*a*, 168*b* are attached to the power tong 102 and bell cranks 146, 160, the trolley wheels of movable trolley assembly 138 may be moved further downward within their respective grooves of channels 136, 150 until the carriage assembly 106 is in the second configuration. When the carriage assembly 106 is in the second configuration, the wheels of the movable trolley assembly 138 may be located at approximately the bottom of channels 136, 150.

Alternatively, the carriage assembly 106 may be adjusted from the first configuration to the second configuration by removing the carriage assembly from the power tong 102 and the backup tong 104. The carriage assembly 106 may then be placed on a surface (e.g., ground surface of a rig) and the movable trolley assembly 138 manually adjusted upwardly or downwardly such that after the power tong 102 and the backup tong 104 are reconnected to the carriage assembly 106, the vertical spacing between the power and backup tongs has either been increased or decreased.

By supporting the movable trolley assembly 138, the power tong 102 may provide stability to the carriage assembly 106 to prevent the carriage assembly from pivoting about attachments protrusions 135, 149 during the making up and breaking out tubular connections. When the carriage assembly 106 is in the first configuration shown in FIGS. 1-3, bell cranks 146, 160 may be directly connected to adaptors 109, 111 of the power tong 102 to enable the power tong 102 to support the movable trolley assembly 138. When the carriage assembly 106 is in the second configuration shown in FIGS. 4-6, bell cranks 146, 160 may be indirectly connected to the adaptors of the power tong 102 via suspension cables 168*a*, 168*b* to enable the power tong 102 to support the movable trolley assembly 138.

In one embodiment, suspension cables 168*a*, 168*b* may be chains of a fixed size. Alternatively, the suspension cables may be retractable cables housed within casings (not shown) to enable the cable length to automatically adjust (i.e., increase or decrease) as the carriage assembly moves from the first configuration to the second configuration and vice versa. In such an embodiment, one end of the suspension cables may be attached to adaptors 109, 111 and the casings may be attached to bell cranks 146, 160 when the carriage assembly 106 is in the first configuration. As the carriage assembly 106 adjusts from the first configuration to the second configuration, the cables remain attached to the adaptors 109, 111 and the casings remain attached to bell cranks 146, 160, with the cable length increasing as additional cable is deployed from the casings while the vertical spacing between the power tong 102 and the backup tong 104 is increasing. In this manner, the power tong 102 would support the movable trolley assembly 138 via the retractable cables. Alternatively, the casings may be attached to adaptors 109, 111 and one end of the suspension cables may be attached to bell cranks 146, 160. A person of ordinary skill in the art will understand that other connecting mechanisms (for example, hydraulic cylinders or adjustable telescoping tubular links) could be used in place of suspension cables 168*a*, 168*b*.

In one embodiment, the carriage assembly 106 includes a drive motor (not shown) and programmable logic controller (PLC, not shown). The movable trolley assembly 138 may be attached to the drive motor such that by using the PLC, the drive motor will operate to either raise or lower the movable trolley assembly, thereby adjusting the carriage assembly 106 from one configuration to another configuration. In this embodiment, tong assembly 100 may be supported from a handling tool (not shown). The handling tool may be attached to the power tong 102 and hold the power tong stationary relative to the ground surface while the backup tong 104 moves upwardly and/or downwardly with the movable trolley assembly 138 upon operation of the drive motor. Alternatively, tong assembly 100 may be supported by a stand (not shown) that remains stationary relative to a ground surface. The stationary stand may be attached to the power tong 102 such that the power tong also remains stationary relative to the ground surface while the backup tong 104 moves upwardly and/or downwardly with the movable trolley assembly 138 upon operation of the drive motor.

In yet another embodiment shown in FIGS. 9-10, the tong assembly 100 may be attached to a stand having an adjustable upper portion and a stationary lower portion. The adjustable upper portion may be vertically movable relative to a ground surface while the stationary lower portion may remain stationary relative to the ground surface. The adjustable upper portion may be attached to the power tong 102 such that upon raising and/or lowering the adjustable upper portion, the power tong 102 moves upwardly and/or downwardly with the movable trolley assembly 138 to adjust the carriage assembly 106 from one configuration to another configuration.

To minimalize the vertical footprint of carriage assembly 106, the carriage assembly may be designed such that movable trolley assembly 138 is located axially between the power tong 102 and backup tong 104 when the carriage assembly 106 is connected to the tong assembly 100, regardless of the configuration of the carriage assembly. Such a design of the carriage assembly 106 enables the power tong 102 to connect and provide support to movable trolley assembly 138 during operation of the tong assembly 100, which may help stabilize the carriage assembly 106 and alleviate some of the force placed upon the movable trolley assembly 138 via its connection to backup tong 104 during operation of the tong assembly.

Figure 11:
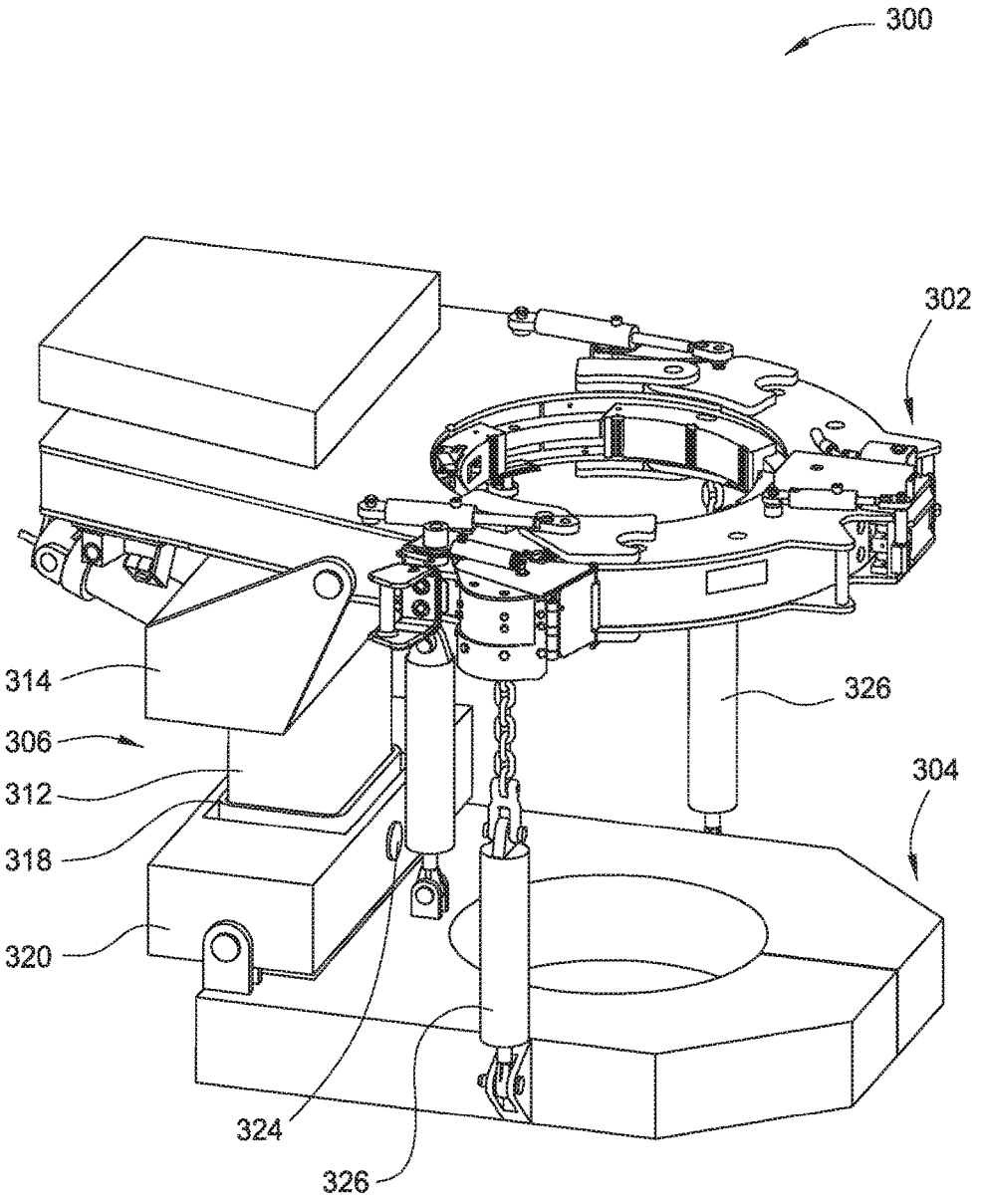
FIG. 11 illustrates an alternative embodiment of a movable tong assembly.
Figure 12:
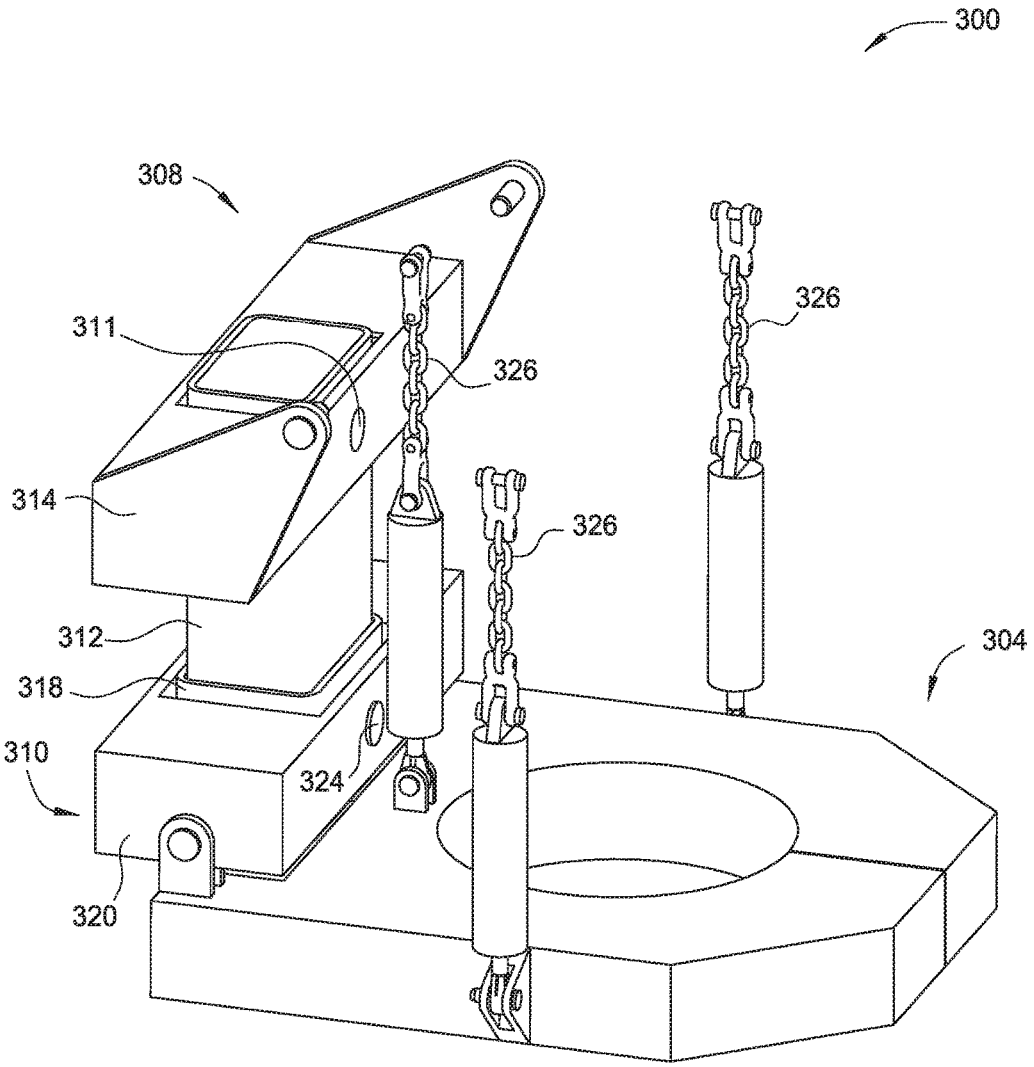
FIG. 12 illustrates an embodiment of a carriage assembly of the movable tong assembly shown in FIG. 11.

An alternative embodiment of a movable tong assembly 300 with a vertical torque bar is illustrated in FIGS. 11-12. In the alternative embodiment, the tong assembly includes a power tong 302 and a backup tong 304 operatively connected by a carriage assembly 306. The power tong and backup tong may be substantially similar to (or even identical to) power tong 102 and backup tong 104 the movable tong assembly 100.

In this embodiment, the carriage assembly 306 may comprise a bracket assembly 308 and a trolley assembly 310. As seen in FIG. 12, the bracket assembly 308 may comprise a vertical torque bar 312 and a bracket 314. The bracket 314 may pivotally connect to opposite sides of the power tong 302 and may be pivotally connected to an upper portion of the vertical torque bar 312 by a pin 311. The bracket assembly 308 may be arranged such that the bracket 314 and the vertical torque bar 312 are supported by the power tong 302.

The trolley assembly 310 may comprise a first trolley member 318 and a second trolley member 320. The first trolley member 318 may be slidably connected to the vertical torque bar 312. The second trolley member 320 may be pivotally connected to the first trolley member 318 via a pin 324. The second trolley member 320 may also be pivotally connected to the backup tong 304, such that the second trolley member 320 and backup tong 304 are movable relative to the power tong 302 as the first trolley member 318 slides along the vertical torque bar 312.

In this embodiment, the power tong 302 may be connected to the backup tong 304 via suspension cables 326. The suspension cables 326 may be configured to compensate for a length adjustment as the backup tong 304 is moved relative to the power tong 302. For example, the suspension cables 326 may be retractable cables housed within casings (not shown) to enable the cable length to automatically adjust (i.e., increase or decrease) as the carriage assembly 306 moves from a first configuration to a second configuration and vice versa. Alternatively, each of the suspension cables 326 may comprise a fixed length chain and a spring element, with the fixed length chain being attached to one of tongs and the spring element being attached to the other tong. Alternatively, each of the suspension cables 326 may comprise a spring element between two fixed length chains attached to the tongs, the spring element enabling the suspension cables to compensate for a length adjustment as the backup tong is moved relative to the power tong. Alternatively, the suspension cables 326 may be replaced with hydraulic cylinders.

In operation, the first trolley member 318 may be adjusted to slide upwardly or downwardly along the vertical torque bar 312, thereby adjusting the vertical spacing between the power tong 302 and the backup tong 304. In such a situation, the first trolley member 318 may be connected to a drive motor and PLC (not shown) to enable the member to be adjusted. As the adjustment of the vertical spacing between the power tong 302 and backup tong 304 is occurring, the suspension cables 326 compensate for the length adjustment. In this manner, the alternative embodiment shown in FIGS. 11-12 allows for the vertical spacing between the power tong 302 and the backup tong 304 to be adjusted.

Figure 13:
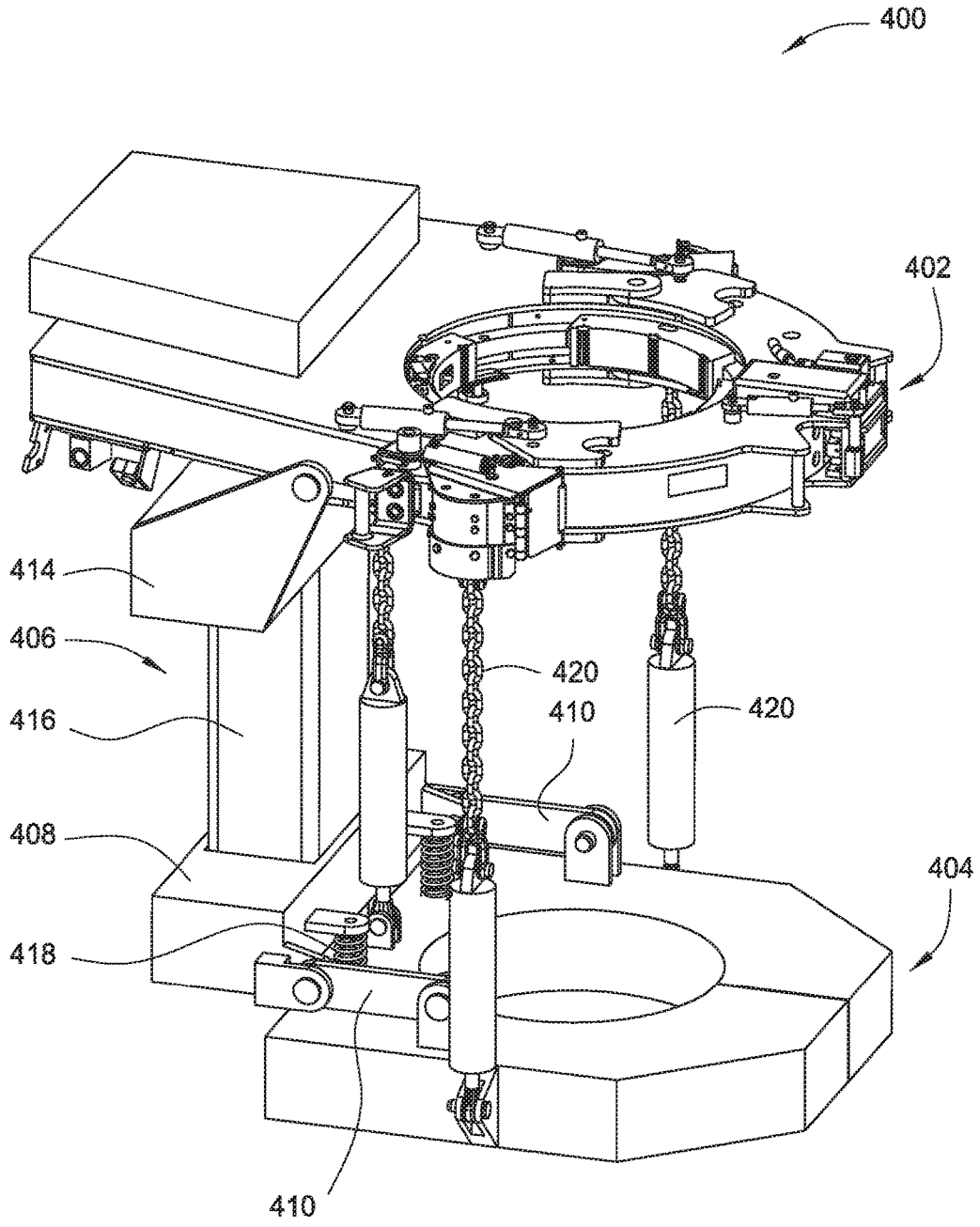
FIG. 13 illustrates another alternative embodiment of a movable tong assembly.
Figure 14:
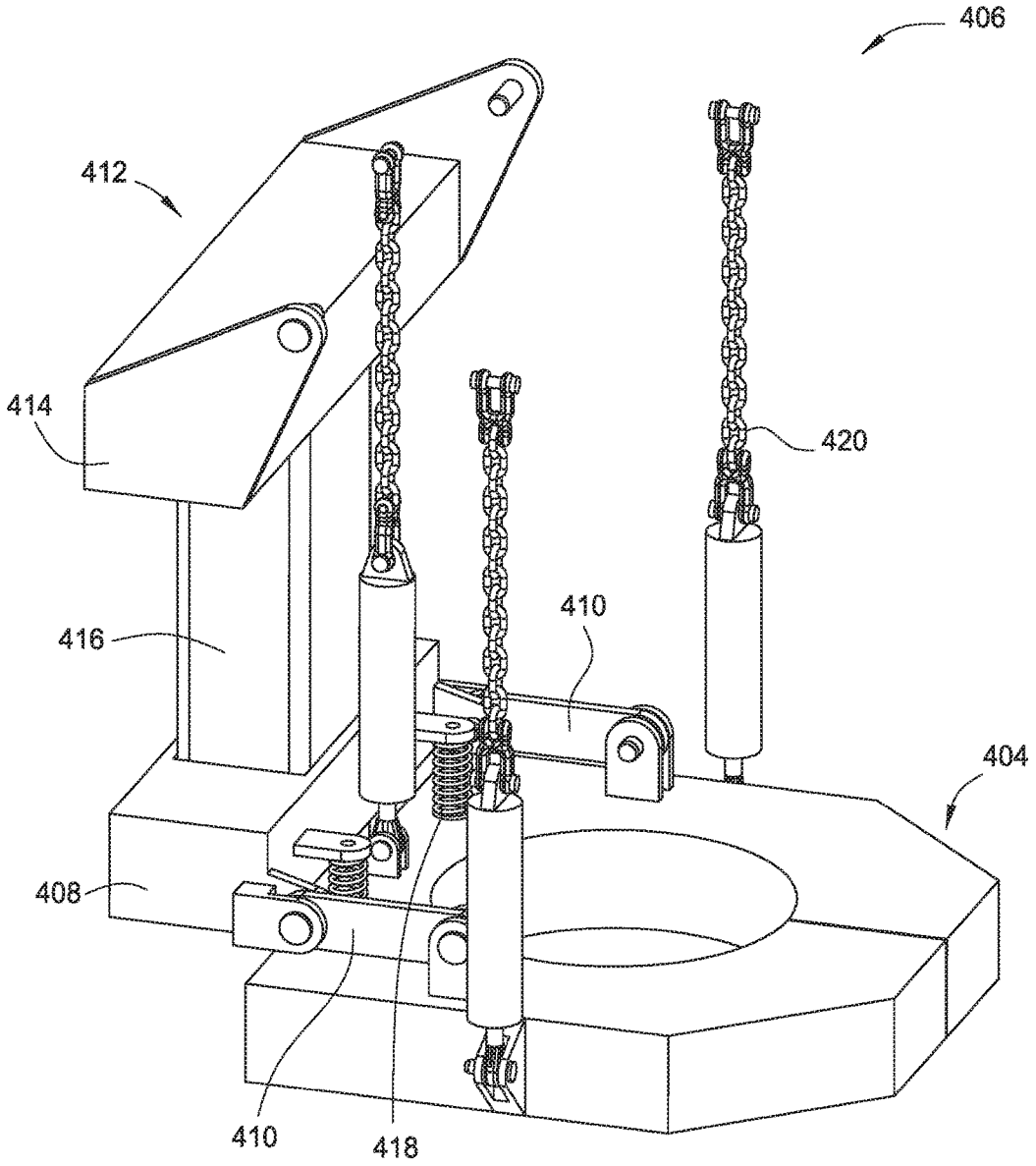
FIG. 14 illustrates an embodiment of a carriage assembly of the movable tong assembly shown in FIG. 13.

Another alternative embodiment of a movable tong assembly 400 with a power tong 402, a backup tong 404, and a carriage assembly 406 is shown in FIGS. 13-14. This alternative embodiment is substantially similar to the embodiment shown in FIGS. 11-12, with the exception that the carriage assembly 406 only includes one trolley member 408 that is connected to the backup tong 404 via a pair of links 410. A bracket assembly 412 may include a bracket 414 and a vertical torque bar 416. The trolley member 408 may be slidably connected to a vertical torque bar 416, such that the backup tong 404 is movable relative to the power tong 402 as the trolley member 408 slides along the vertical torque bar 416. The movable tong assembly 400 may further include spring elements 418 and suspension cables 420.

During makeup of a pipe connection, the torque of the tong assembly 400 creates a reaction force pair at the location of the vertical torque bar 416 and the trolley member 408. This in turn creates friction force acting at the backup tong 404, thereby resulting in a bending moment at the pipe connection. The spring elements 418 and the links 410 may help reduce this bending moment. More specifically, if the friction force between the trolley 408 and the vertical torque bar 416 exceeds the spring force of spring elements 418, the trolley member 408 will lock-up with the vertical torque bar 416 and links 410 will begin to rotate, limiting the bending moment at the pipe connection. Depending upon the vertical spacing needed, the trolley member 408 may be adjusted to slide upwardly or downwardly along the vertical torque bar 416, thereby adjusting the vertical spacing between the power tong 402 and the backup tong 404. The trolley member 408 may be connected to a drive motor and PLC (not shown) to enable the member to be adjusted. As the adjustment of the vertical spacing between the power tong 402 and backup tong 404 is occurring, the suspension cables 420 compensate for the length adjustment. In this manner, the alternative embodiment shown in FIGS. 13-14 allow for the vertical spacing between the power tong 402 and the backup tong 404 to be adjusted. Like the other embodiments disclosed herein, the movable tong assembly 400 can be supported above a ground surface by a support structure (for e.g., a stand or a handling tool).

Figure 15:
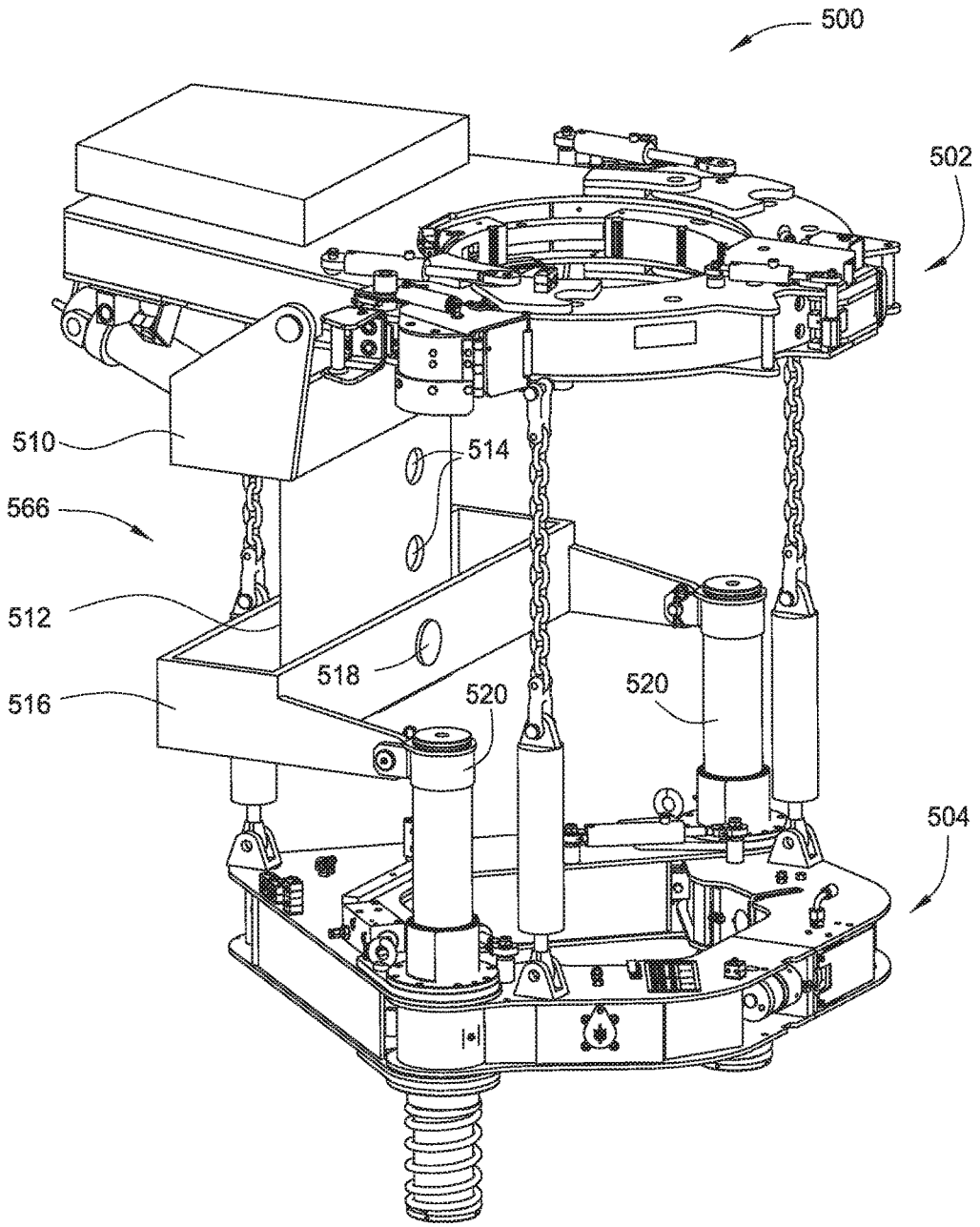
FIG. 15 illustrates another alternative embodiment of a movable tong assembly.
Figure 16:
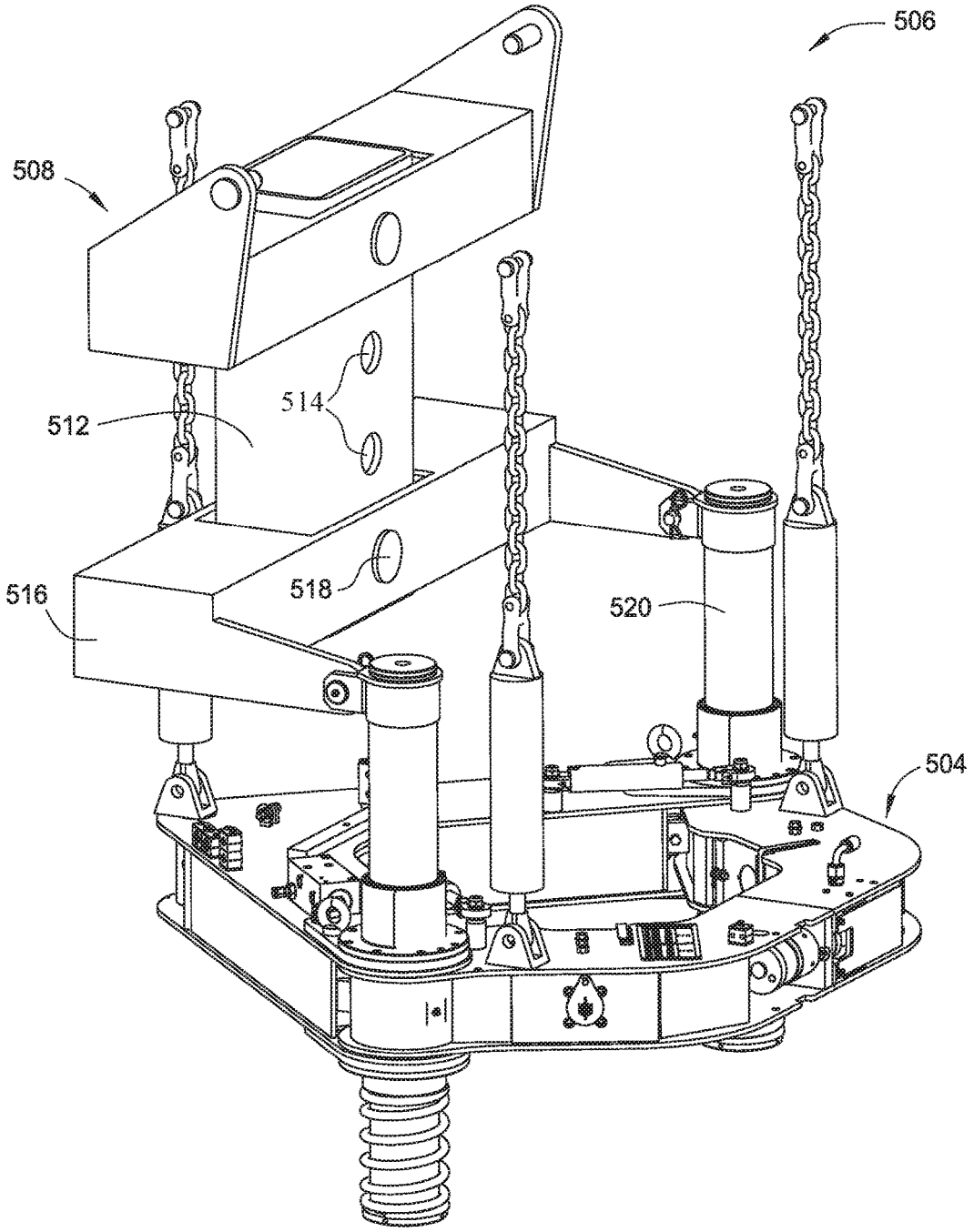
FIG. 16 illustrates an embodiment of a carriage assembly of the movable tong assembly shown in FIG. 15.

Another alternative embodiment of a movable tong assembly 500 including a power tong 502, a backup tong 504, and a carriage assembly 506 is shown in FIGS. 15-16. This alternative embodiment is substantially similar to the embodiments shown in FIGS. 11-14. A bracket assembly 508 includes a bracket 510 and a vertical torque bar 512. The vertical torque bar 512 may contain a plurality of through-holes 514 that enable a trolley member 516 to be incrementally adjusted along the vertical torque bar. A through-pin 518 may connect the trolley member 516 to the vertical torque bar 512. In addition, the trolley member 516 may indirectly connect to backup tong 504 via support legs 520. In operation, the vertical spacing between the active tong 502 and the backup tong 504 can be adjusted incrementally by removing through-pin 518 and sliding the trolley member 516 upwardly or downwardly along the vertical torque bar 512. After the desired vertical spacing is achieved, the through-pin 518 can be reinserted to fix the trolley member 516 to the vertical torque bar 512. Alternatively, the trolley member 516 could contain an additional trolley member similar to trolley member 318 described above.

Embodiments of the present disclosure provide a tong assembly. The tong assembly includes a power tong, a backup tong, and a carriage assembly operatively connecting the power tong and the backup tong. The carriage assembly includes a movable trolley assembly connected to the power tong. The carriage assembly is connected to the power tong in a manner such that the power tong supports the movable trolley assembly. The movable trolley assembly is axially located between the power tong and the backup tong. The movable trolley assembly is configured to axially move the power tong and backup tong relative to each other.

In one or more embodiments of the present disclosure, the movable trolley assembly is connected to the backup tong and the carriage assembly further includes a bracket assembly pivotally connected to the power tong. The movable trolley assembly is slidably connected to the bracket assembly to operatively connect the power tong and the backup tong.

In one or more embodiments of the present disclosure, the carriage assembly includes a suspension cable connecting the power tong to the movable trolley assembly.

In one or more embodiments of the present disclosure, the bracket assembly includes first and second brackets spaced from each other. Each of the first and second brackets has a connecting end and a free end. The connecting end of each of the first and second brackets is pivotally connected to the power tong, and the free end of each of the first and second brackets is spaced below the power tong.

In one or more embodiments of the present disclosure, the bracket assembly includes a torque bar located between and connected to the first bracket and the second bracket.

In one or more embodiments of the present disclosure, the torque bar is a first torque bar and the carriage assembly includes a second torque bar spaced from the first torque bar, with the second torque bar being connected to the movable trolley assembly.

In one or more embodiments of the present disclosure, the first bracket includes a first channel and the second bracket includes a second channel. The movable trolley assembly is slidably connected to the first and second channels to enable axial movement of the movable trolley assembly relative to the first and second brackets. The movable trolley assembly is attached to first and second support legs of the backup tong.

In one or more embodiments of the present disclosure, the carriage assembly includes first and second suspension cables, with the first and second suspension cables connecting the movable trolley assembly to the power tong.

In one or more embodiments of the present disclosure, the carriage assembly is adjustable between a first configuration and a second configuration. The power tong is spaced from the backup tong by a first vertical distance when the carriage assembly is in the first configuration and by a second vertical distance when the carriage assembly is in the second configuration. The second vertical distance is greater than the first vertical distance. The carriage assembly includes first and second torque bars arranged in a manner such that the first torque bar is located axially above the second torque bar when the carriage assembly is in the first configuration and the second torque bar is located axially above the first torque bar when the carriage assembly is in the second configuration.

In one more embodiments of the present disclosure, the tong assembly includes a power tong, a backup tong, a support structure, and a carriage assembly. The support structure is configured to support the power tong above a ground a surface. The carriage assembly operatively connects the power tong and the backup tong, with the carriage assembly configured to axially adjust a vertical distance between the power tong and backup tong. The carriage assembly is distinct and separate from the support structure.

In one or more embodiments of the present disclosure, the support structure is a stand.

While the foregoing is directed to embodiments of the present disclosure, other and further embodiments of the disclosure may be devised without departing from the basic scope thereof, and the scope thereof is determined by the claims that follow.

The invention claimed is:

1. A tong assembly comprising:

a power tong;

a backup tong; and a carriage assembly operatively connecting the power tong and the backup tong, the carriage assembly including a movable trolley assembly coupled to a bracket assembly, the movable trolley assembly axially located between the power tong and the backup tong, the movable trolley assembly being connected to the backup tong and configured to axially move the backup tong relative to the power tong and the bracket assembly, wherein the bracket assembly is pivotally connected to the power tong, and wherein the movable trolley assembly is slidably connected to the bracket assembly to operatively connect the power tong and the backup tong.

2. The tong assembly of claim 1, wherein the bracket assembly includes a vertical torque bar.

3. The tong assembly of claim 1, wherein the carriage assembly includes a suspension cable connecting the power tong to the movable trolley assembly.

4. The tong assembly of claim 1, wherein the bracket assembly includes first and second brackets spaced from each other, each of the first and second brackets have a connecting end and a free end, the connecting end of each of the first and second brackets pivotally connected to the power tong and the free end of each of the first and second brackets spaced below the power tong.

5. The tong assembly of claim 4, wherein the bracket assembly includes a horizontal torque bar located between and connected to the first bracket and the second bracket.

6. The tong assembly of claim 5, wherein the horizontal torque bar is a first horizontal torque bar and the carriage assembly includes a second horizontal torque bar spaced from the first horizontal torque bar, the second horizontal torque bar being connected to the movable trolley assembly.

7. The tong assembly of claim 6, wherein the first bracket includes a first channel and the second bracket includes a second channel, the movable trolley assembly being slidably connected to the first and second channels to enable axial movement of the movable trolley assembly relative to the first and second brackets, the movable trolley assembly being attached to first and second support legs of the backup tong.

8. The tong assembly of claim 1, wherein the carriage assembly is adjustable between a first configuration and a second configuration, the power tong is spaced from the backup tong by a first vertical distance when the carriage assembly is in the first configuration and by a second vertical distance when the carriage assembly is in the second configuration, the second vertical distance being greater than the first vertical distance, the carriage assembly including first and second horizontal torque bars arranged in a manner such that the first horizontal torque bar is vertically above the second horizontal torque bar when the carriage assembly is in the first configuration and the second horizontal torque bar is vertically above the first horizontal torque bar when the carriage assembly is in the second configuration.

9. The tong assembly of claim 1, wherein the movable trolley assembly further comprises wheels disposed in channels of the bracket assembly.

10. The tong assembly of claim 1, wherein the movable trolley assembly is connected to support legs of the backup tong.

11. A tong assembly comprising:

a power tong;

a backup tong;

a carriage assembly having a bracket assembly connected to the power tong and a movable trolley assembly connected to the backup tong, and a support structure coupled to the power tong and configured to move the power tong and the bracket assembly relative to the movable trolley assembly to adjust a vertical distance between the power tong and the backup tong, wherein the movable trolley assembly is connected to the power tong in a manner such that the power tong supports the movable trolley assembly, the movable trolley assembly axially located between the power tong and the backup tong, the movable trolley assembly configured to axially move the power tong and backup tong relative to each other, and wherein the bracket assembly includes first and second brackets spaced from each other, each of the first and second brackets has a connecting end and a free end, the connecting end of each of the first and second brackets pivotally connected to the power tong and the free end of each of the first and second brackets spaced below the power tong.

12. The tong assembly of claim 11, wherein the bracket assembly includes a bracket pivotally connected to the power tong and a vertical torque bar.

13. The tong assembly of claim 11, wherein the first bracket includes a first channel and the second bracket includes a second channel, the movable trolley assembly being slidably connected to the first and second channels to enable axial movement of the movable trolley assembly relative to the first and second brackets, the movable trolley assembly being attached to first and second support legs of the backup tong.

14. The tong assembly of claim 13, wherein the carriage assembly includes a first horizontal torque bar and a second horizontal torque bar spaced from the first horizontal torque bar, the first horizontal torque bar located between and connected to the first bracket and the second bracket, the second horizontal torque bar connected to the movable trolley assembly such that the second horizontal torque bar is movable relative to the first and second brackets.

15. A tong assembly comprising:

a power tong;

a backup tong; and a carriage assembly operatively connecting the power tong and the backup tong, the carriage assembly including a movable trolley assembly coupled to a bracket assembly, the movable trolley assembly axially located between the power tong and the backup tong, the movable trolley assembly being connected to the backup tong and configured to axially move the backup tong relative to the power tong and the bracket assembly, wherein the movable trolley assembly includes:

a pair of trolley brackets; and a torque bar connected between the pair of trolley brackets.

16. The tong assembly of claim 15, wherein a proximal end of the trolley brackets is coupled to the bracket assembly, and a distal end of the trolley brackets is coupled to the power tong.

17. The tong assembly of claim 16, wherein the trolley brackets are coupled to the power tong using cables.

18. A tong assembly comprising:

a power tong;

a backup tong; and a carriage assembly operatively connecting the power tong and the backup tong, the carriage assembly including a movable trolley assembly coupled to a bracket assembly, the movable trolley assembly axially located between the power tong and the backup tong, the movable trolley assembly being connected to the backup tong and configured to axially move the backup tong relative to the power tong and the bracket assembly, wherein the movable trolley assembly includes wheels disposed in channels of the bracket assembly.

19. A tong assembly comprising:

a power tong;

a backup tong; and a carriage assembly operatively connecting the power tong and the backup tong, the carriage assembly including a movable trolley assembly coupled to a bracket assembly, the movable trolley assembly axially located between the power tong and the backup tong, the movable trolley assembly being connected to the backup tong and configured to axially move the backup tong relative to the power tong and the bracket assembly, wherein the movable trolley assembly is connected to support legs of the backup tong.

20. The tong assembly of claim 19, further comprising a link for connecting the movable trolley assembly to the support legs.

21. The tong assembly of claim 20, wherein the movable trolley assembly further comprises:

a pair of trolley brackets; and a torque bar connected between the pair of trolley brackets.

22. The tong assembly of claim 21, wherein the movable trolley assembly includes wheels disposed in channels of the bracket assembly.

* * * * *